United States Patent [19]

Leonhard et al.

[11] Patent Number: 4,672,808

[45] Date of Patent: Jun. 16, 1987

[54] APPARATUS FOR THE REMOVAL OF COMBUSTIBLE SOLID PARTICLES FROM THE EXHAUST GASES OF INTERNAL COMBUSTION ENGINES

[75] Inventors: Rolf Leonhard, Schwieberdingen; Hubert Dettling, Waiblingen, both of Fed. Rep. of Germany

[73] Assignee: Robert Bosch GmbH, Stuttgart, Fed. Rep. of Germany

[21] Appl. No.: 873,183

[22] Filed: Jun. 11, 1986

[30] Foreign Application Priority Data

Jul. 20, 1985 [DE] Fed. Rep. of Germany ..... 3526074

[51] Int. Cl.[4] ..... F01N 3/02; F01N 3/26

[52] U.S. Cl. ..... 60/286; 60/303

[58] Field of Search ..... 60/303, 286, 298; 431/115, 116, 215

[56] References Cited

U.S. PATENT DOCUMENTS 3,994,131 11/1976 Karino ..... 60/303
4,406,119 9/1983 Kamiya ..... 60/303
4,459,805 7/1984 Kamiya ..... 60/303
4,571,938 2/1986 Sakurai ..... 60/303

*Primary Examiner*—Douglas Hart
*Attorney, Agent, or Firm*—Felfe & Lynch

[57] ABSTRACT

An apparatus for the burning of solid particles, especially soot particles, separated from the exhaust gas from internal combustion engines has a rotationally symmetrical combustion chamber which coaxially adjoins an ignition burner connected with it by a flame transfer orifice. Fuel and air are metered to the ignition burner through an additional-air line and a fuel line and, as a prepared mixture, they are ignited in the ignition burner and enter the combustion chamber through a flame transfer orifice. In the combustion chamber an exhaust gas partial stream enriched with the solid particles is introduced, and, after the solid particles have been consumed together with the additional air put into the combustion chamber, the exhaust gas is then discharged again as cleaned exhaust together with the remaining combustion products through an outlet tube.

16 Claims, 1 Drawing Figure

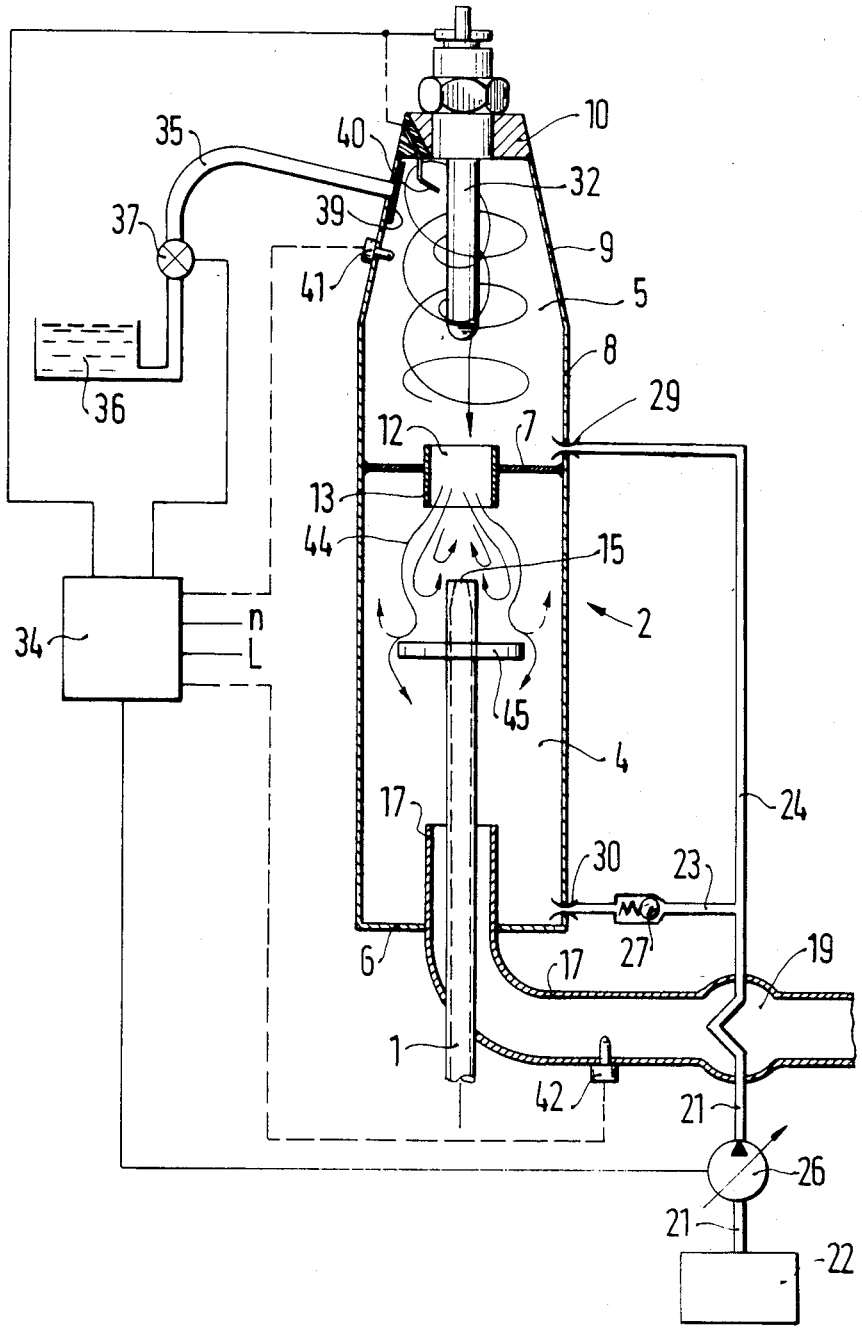
35
40
10
32
37
39
9
41
5
8
36
29
12
7
13
44
15
34
n
L
2
45
4
17
24
30
23
6
27
17
19
1
42
21
26
21
22

APPARATUS FOR THE REMOVAL OF COMBUSTIBLE SOLID PARTICLES FROM THE EXHAUST GASES OF INTERNAL COMBUSTION ENGINES

This invention relates to apparatus for the removal of combustible solid particles from the exhaust gases of internal combustion engines In such an apparatus, disclosed in German patent application No. P 34 24 196.5, the exhaust gas coming from the internal combustion engine is divided by means of an electrostatic soot deflector and a centrifugal force separator following it, into an exhaust gas stream which is enriched with combustible solid particles, especially soot, and which is largely freed of such particles in a partial stream of exhaust gas. The partial stream of exhaust gas enriched with combustible solid particles is, in the known apparatus, fed to a combustion chamber, preferably with the addition of a fuel-air mixture, and both media, the soot-laden exhaust gas and the fuel-air mixture, are fed through an electrical heater where they are burned. These combustion components are introduced through a common tube coaxially into the cylindrical combustion chamber, the heater itself being disposed within the tube. The combustion products are then carried out of the combustion chamber countercurrently downstream from the electrical heater close to the mouth of the tube.

This system has the disadvantage that a considerable amount of electrical energy is required for the burning of the combustible solid particles, combined with a complex control of additional air, additional fuel and heating power for the heating element in which, on the one hand, the necessary ignition temperature has to be maintained, and on the other hand overheating must be prevented on account of the danger of the failure of this heating system. At the same time the thermal stress on the heating element is unfavorably affected also by the amount of the injected fuel-air mixture and the input of combustible solid particles. Furthermore, everything that leaves the tube is carried into the atmosphere through the outlet at the end of the combustion chamber. If the soot introduced into the combustion chamber should not be completely burned up, it is again filtered out by a complex additional filter and the remaining gases are fed to the outlet. This additional filter signifies additional complexity, with the danger that the filter may be damaged in the long run by high afterburning temperatures. It is then not impossible, either, that unburned solid particles may reach the outlet. Also, the filter increases the back pressure on the exhaust gas side, which impairs the efficiency of the combustion systems that precede it.

On the other hand, the apparatus according to the invention, has the advantage that electrical energy is required only to ignite the fuel-air mixture in the ignition burner, which substantially extends the life of the ignition system and also very appreciably reduces the energy required for the operation of the system. The supply of energy to the ignition burner and to the combustion chamber can furthermore be increased as desired, so that the combustion system can easily be adapted to different rates of production of exhaust gas and solid particles. The combustion system operates at high efficiency, because its operation does not call for the production of electrical energy for a constantly operating ignition system, with corresponding losses.

By an advantageous further development the rate of flow of the exhaust gas partial stream entering the combustion chamber can be limited, thus preventing the calibrated orifice from becoming clogged by solid particles deposited on it in the course of operation, since the temperature prevailing in the flame area continually burns the calibrated orifice free.

By an additional further development of the invention an optimum turbulence of the entering fuel is achieved by the injected air, so that, due to the uniform composition of the mixture, a stable pilot flame can be maintained, which burns into the combustion chamber through the flame transfer orifice. Due to the rotary flow of air, the thermal stress on the circumferential surfaces of the ignition burner and of the cylindrical combustion chamber is kept low, and at the same time the exhaust gas partial stream which is charged with the solid particles is preheated by the combustion products. A refractory lining of the circumferential walls of the system according to the invention is thus unnecessary. In an especially advantageous manner, a stable ignition of the fuel entering the combustion chamber with the entering air is achieved by the incandescent body, even in pulsating operation, since the ignition is performed not just by the continued burning of a flame once ignited, but also by the hot surface of the incandescent body.

Advantageously, the incandescent body and electrically operated ignition system can be realized by an electrically heated glow plug such as is already available for other uses in motor vehicles. In an advantageous further development, the ignition chamber is constructed in which the distance between a central incandescent body and the point of entry of fuel on the wall of the ignition burner can be kept short and an elevated turbulence and improved carburetion is achieved on the basis of the increasing velocity of rotation in the portion of narrow diameter.

The assurance preferably is advantageously provided that the energy input to the apparatus according to the invention is kept as low as possible, and for the start-up of the entire system, and as a safety system for the safe operation of the system, provision preferably is made for the operation of the electrically powered ignition device under the control of a flame detecting system. In a preferred embodiment one obtains a simple possibility for the metering and distribution of the additional air to the combustion chamber on the one hand and to the ignition burner on the other. In a preferred embodiment the power requirement can be lowered and the amount of additional fuel input can be reduced on account of the improvement of efficiency thus achieved. Furthermore, for the formation of a stable flame it is possible to add combustion aids to the fuel, and it is advantageous that the amount of fuel needed for the operation of the system is very small and can be stored separately in a fuel tank. Thus there is no need for a system for drawing fuel from the main fuel tank and for metering the catalytically active combustion aids to this fuel.

In accordance with the invention, apparatus for the removal of combustible solid particles, especially soot, from exhaust gas from an internal combustion engine, especially one having a separator system whereby an exhaust gas partial stream enriched with combustible solid particles is formed, comprises a combustion system with a cylindrical combustion chamber having a cylindrical wall, a dividing wall, and a bottom end. The apparatus also includes an injection pipe carrying a stream of exhaust gas from the internal combustion engine and extending into the combustion chamber from the bottom end thereof. The apparatus also includes inlet means for supplying additional air and additional fuel and an outlet for the combustion products of additional air, additional fuel, combustible solid particles and for exhaust gas. The apparatus also includes a firing zone downstream from the issue of the solid particles from the injection pipe. The means for supplying additional air and additional fuel includes at least one additional-air line leading into the combustion chamber tangentially to the cylindrical wall of the combustion chamber. The injection pipe carrying the combustible solid particles discharges freely into the combustion chamber. The outlet, over a portion of the length of the injection pipe, surrounds the injection pipe. The outlet comprises an exit tube leading out through the bottom end of the combustion chamber. The apparatus also includes a flame transfer orifice for introducing the additional air and the additional fuel, the flame transfer orifice being in the dividing wall of the combustion chamber and being situated coaxially with the injection pipe and having an upstream end. The apparatus also includes an ignition burner for forming a burning mixture adjoining the upstream end of the transfer orifice.

For a better understanding of the invention, together with other and further objects thereof, reference is made to the following description, taken in connection with the accompanying drawings, and its scope will be pointed out in the appended claims.

Referring to the drawing:

The figure is a sectional view, partly diagrammatic, representing a preferred embodiment of the invention.

Referring now to the figure of the drawing, the exhaust gas emitted by an internal combustion engine, not shown, to the exhaust manifold system passes through an electrostatic soot deflector known, for example, through German Gebrauchsmuster No. 84 04 203, to a separating system in the form of a centrifugal-force separator at whose one outlet exhaust gas emerges which is extensively freed of soot and solid particles, and at whose other outlet an exhaust gas partial stream emerges which is enriched with separated soot; and solid particles. This exhaust gas partial stream preferably is fed through an injection tube 1 of a combustion system 2, as represented in the figure.

The combustion system 2 preferably is divided into a cylindrical combustion chamber 4 and an ignition burner 5 adjoining the latter coaxially. The combustion chamber 4 preferably has a cylindrical body which terminates at one end in a first end wall or bottom 6 and at the other end in a second end wall or second end wall or dividing wall 7. This dividing wall preferably is simultaneously one end of the adjoining ignition burner 5, which in the present example has a cylindrical portion 8 which directly adjoins the dividing wall 7 and has a truncoconical portion 9 tapering away from it. This portion terminates in an end wall 10. The ignition burner 5 preferably is connected to the combustion chamber 4 by a flame transfer orifice 12 which preferably is formed by a short section of pipe 13 which is inserted into the dividing wall 7 coaxially with the combustion chamber axis 4.

The injection tube 1 preferably extends from the bottom end 6 coaxially into the interior of the combustion chamber 4 to a point close to the flame transfer orifice 12 and has at its own mouth at that location a calibrated orifice 15. Furthermore, an exit tube 17 preferably extends from the bottom end 6 into the combustion chamber 4. Preferably, this exit tube concentrically surrounds on a substantially larger diameter the injection tube 1, and extends over only a small portion of the length of the injection tube within the combustion chamber 4. Outside of the combustion chamber 4 the injection tube 1 breaks through the exit tube 17 serving as an outlet tube, and the exit tube 17 preferably leads through a heat exchanger 19 to the part of the exhaust gas system which discharges the cleaned exhaust gases. The outlet tube, however, can also lead directly to the ambient atmosphere, with the interposition, if desired, of certain noise suppressing means.

The medium which is to be heated in the heat exchanger 19 by the hot exhaust gas is the additional air which is to be brought into the combustion chamber and the ignition burner. This air preferably is fed from an air source 22 through an air pipe 21 to the heat exchanger 19 and from there it preferably is introduced through a first additional-air line 23 into the combustion chamber 4, and through a second additional-air line 24 into the ignition burner 5. Furthermore, an air metering system 26 preferably is provided, by which the additional air fed to the combustion system is controlled, preferably by controlling the air pumping pressure. The first additional-air line 23 furthermore preferably contains a pressure valve 27 which opens if a preset pressure to the combustion chamber 4 is exceeded. The first additional-air line 23 preferably discharges into the combustion chamber close to the bottom end 6 tangentially to the cylindrical wall of the combustion chamber. Also the second additional-air line 24 preferably discharges into the ignition burner 5 tangentially to the cylindrical portion 8 of the ignition burner, close to the dividing wall 7. If desired, a pressure valve and/or a throttle 29 can be provided also in this additional-air line 24. With these means the air distribution between the first additional-air line 23 and the second additional-air line 24 can advantageously be adjusted. In the first additional-air line 23, too, preferably the provision of a throttle 30 is applicable for this purpose.

Furthermore, an incandescent body 32 preferably is provided in the ignition burner, which can be a so-called glow plug such as those known for assisting the starting of self-ignition internal combustion engines, or it can be a simple incandescent body thermally insulated from its mounting, which is heated by the heat that develops from the combustion in the ignition burner. In the first case, the glow plug preferably is introduced through the end wall 10 into the ignition burner coaxially with the axis of the latter, and is supplied with electrical current by a control system 34. If, instead of the glow plug an incandescent body of similar configuration is used, an additional ignition device must be provided in the ignition burner, which is disposed preferably in the vicinity of the top end 10, where a fuel line 35 preferably discharges in the area of the truncoconical periphery of the ignition burner portion 9. This fuel line runs from a fuel supply tank 36 and contains a fuel feeding system 37 by which the amount of the additional fuel introduced through the fuel line 36 into the ignition burner is metered. The additional fuel is introduced at a low pressure level, so that a pressure raising system, such as the one needed in fuel injection, is not required. The fuel can enter the ignition burner through a plurality of openings of the nature of sieve openings. For example, the point of entry can be covered with a screen 39. But other systems for the production of a large fuel yielding surface area, such as sintered bodies, for example, can be used at this point.

By means of the control system, the fuel metering system 37, the air metering system 26 and the ignition system 40 or glow plug 32, as the case may be, are controlled. As the guiding parameters for the control of air and fuel, the control system 34 is supplied with control data which convey information on the combustible solid particles encountered per unit of time. Such parameters can be, for example, the rotary speed, and also the load under which the internal combustion engine is operated. They can also be signals relating to exhaust gas turbidity or other such parameters. An additional control value fed to the control system 34 is a signal which gives information as to whether a flame is burning in the ignition burner or whether the temperature at the outlet 17 indicates that the combustion system is operating properly.

If the combustion system is placed in operation, additional air is injected at a controlled rate into the combustion system through the additional-air lines 23 and 24, and, on the other hand, an amount of fuel corresponding to this air is fed through the fuel line 35. The air entering though the additional-air line 24 produces a rotating movement of air within the ignition burner 5, whose angular velocity increases toward the conically tapering portion 9. The fuel is injected through the screen 39 into this rapidly rotating flow of air and is quickly converted to a uniform combustion mixture of additional air and fuel. When operation is started this mixture must be ignited, and this can be detected by means of a flame-out detector 41 in the firing area or by means of a temperature sensor 42 which is inserted into the outlet 17 upstream from the heat exchanger 19. These sensors can be provided together or separately, and in the starting phase they can be replaced by a timing circuit during whose waiting period the ignition system is started up. Such a time control system is advantageous especially when an electrically heated glow plug 32 is provided as the electrically operated ignition device. These plugs require a certain heat-up phase before the mixture can be ignited by them. After starting and the ignition of the prepared fuel-air mixture the flame in the ignition burner continues to burn and can then be detected by means of the flame-out detector 41 supplemented by the timing circuit. The electrical heating of the glow plug is shut off by the control system 34 after the ignition phase and is not turned on again until the flame-out detector, e.g., the sensor 41 or the sensor 42, signals an interruption of the combustion process in the ignition burner. The flame-out detector 41 can operate according to various principles; e.g., optical sensors, resistance-type temperature sensors or ion stream sensors can be used.

During operation the glow plug 32 is continually heated by the fuel-air mixture burning in the ignition burner even when the electrical heater turned off, so that, in the event of a flame-out, the mixture can immediately ignite on the glow plug. If instead of an electrically heated glow plug, however, some other electrically operated ignition device is used, in the form, for example, of a spark ignition device with a firing electrode 40 which is inserted into the wall of the ignition burner and insulated therefrom and fires against a grounded electrode, the use of an additional incandescent body is advantageous and it can be made similar to the glow plug 32. Such an incandescent body would then also extend coaxially with the axis of the ignition burner 5 from the third end wall 10 into the ignition burner, and would advantageously be thermally insulated from the wall of the ignition burner. This incandescent body is then heated up by the burning fuel-air mixture during operation and serves for flame stabilization. For good heat distribution, this incandescent body can also be in the form of a heat pipe.

Thus, after the combustion system has been started up and the fuel-air mixture has been ignited within the ignition burner, it burns in the form of a flame through the flame transfer orifice 12 into the combustion chamber 4 and forms a firing zone 44 downstream from the flame transfer orifice 12. The flame envelops the end of the first tube 1 with its calibrated orifice 15 and burns together with the combustible solids injected through this orifice. By mounting a circular baffle 45 on the tube 1 close to the orifice 15, the firing zone 44 is locally restricted (flame holding effect), which results in a raising of the temperature in the flame area and thus promotes the burn-up of the soot, and still-unburned soot particles are accelerated radially outward so that they are caught by the outer air stream and can re-enter the firing zone 44. Also, additional air is injected into this zone through the first additional-air line 23, and rotates along the cylindrical wall of the combustion chamber 4 toward the dividing wall. Especially after reversing against the dividing wall 7, the additional air is fed to the firing zone 44, so that sufficient oxygen is available for burning the solid particles heated in the firing zone. The combustion products from the burned solid particles and the residual gases, which are free of solid particles, are then discharged coaxially with the tube 1 and with the axis of the combustion chamber through the exit tube 17. Owing to the fact that the injection tube 1 with its calibrated orifice 15 extends directly into the firing zone 44, sufficient heat is always available, which prevents the calibrated orifice 15 from being clogged by soot particles or other solid particles. Also, the injection tube is heated over a long length from its entry into the exit tube 17 by the combustion products, thereby at the same time preheating the input exhaust gas partial stream and the solid particles contained therein. This system thus constitutes a heat exchanger operating on the countercurrent principle.

With this system, a pilot flame is advantageously produced in the ignition burner, which enters into the combustion chamber 4 and provides for a reliable burning of the injected combustible solid particles. By means of the control system it is possible to have precise control of the amount of additional air required for this purpose. The pilot flame is sustained with a high degree of reliability since fuel and additional air are continuously introduced into the ignition burner in a controlled ratio to one another. By means of the flame-out detector and the electrical ignition system, reliable operation is assured. At the same time the combustion system can be operated on very little additional energy, and can be adapted to widely varying amounts of solid particles to be burned per unit of time. Since only small amounts of fuel are needed as additional energy, a separate fuel tank can be used for this system, and catalytically active combustion aids can be added to the fuel to improve its ignition properties. If a separate fuel tank 36 is used, there is no need for a metering system and a supply tank for such substances which, in the other case, would have to be added to the fuel taken from the vehicle's fuel tank.

Fundamentally, the ignition burner can be configured as a cylindrical chamber, in which case, however, the configuration shown in the drawing is to be preferred as regards the greater ease of the ignition of the fuel-air mixture.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. Apparatus for the removal of combustible solid particles, especially soot, from exhaust gas from an internal combustion engine, especially one having a separator system whereby an exhaust gas partial stream enriched with combustible solid particles is formed, comprising:

a combustion system with a cylindrical combustion chamber having a cylindrical wall, a first end wall and second end wall;

an injection pipe carrying a stream of exhaust gas from the internal combustion engine and extending into said combustion chamber from said first end wall thereof;

inlet means for supplying additional air and additional fuel;

an outlet for the combustion products of additional air, additional fuel, combustible solid particles and for exhaust gas;

a firing zone downstream from the issue of the solid particles from said injection pipe;

said means for supplying additional air and additional fuel including at least one additional-air line leading into said combustion chamber tangentially to said cylindrical wall of said combustion chamber, said injection pipe carrying the combustible solid particles discharging freely into said combustion chamber;

said outlet, over a portion of the length of said injection pipe, surrounding said injection pipe, said outlet comprising an exit tube leading out through said first end wall of said combustion chamber;

a flame transfer orifice for introducing the additional air and the additional fuel, said flame transfer orifice being in said second end wall of said combustion chamber and being situated coaxially with said injection pipe and having an upstream end; and an ignition burner for forming a burning mixture adjoining said upstream end of said transfer orifice.

2. Apparatus according to claim 1, in which said injection pipe comprises a calibrated orifice, said combustion chamber having a firing zone in the region of said flame transfer orifice and said injection pipe extending into said firing zone.

3. Apparatus according to claim 2, in which said injection tube has a baffle close to said calibrated orifice.

4. Apparatus according to claim 3, in which said ignition burner is a rotationally symmetrical chamber having first and second ends and said first end being adjacent said flame transfer orifice, and which apparatus comprises an additional-air line adjacent said first end and discharging tangentially to the periphery of said chamber of said ignition burner, and which apparatus includes a fuel line having a mouth which enters said ignition burner near said second end and delivers fuel, and which apparatus includes a fuel metering system, and which apparatus includes an ignition device in the region of said mouth of said fuel line in said ignition burner.

5. Apparatus according to claim 4, which includes an electrically powered ignition system.

6. Apparatus according to claim 5, in which said ignition system includes an incandescent body heated by combustion products within said ignition burner.

7. Apparatus according to claim 6, in which said incandescent body and said electrically powered ignition system comprise an electrically heated glow plug as said ignition device.

8. Apparatus according to claim 5, characterized in that said ignition burner comprises a cylindrical portion and a truncoconical portion tapering toward said mouth of said fuel line.

9. Apparatus according to claim 5, which includes an additional-air source and an air metering system connected to said additional-air line discharging into said combustion chamber and in which said means for supplying additional air and additional fuel includes an additional air line discharging into said ignition burner and connected to said additional-air source and said air-metering system.

10. Apparatus according to claim 9, which includes a fuel metering system and a controller and in which said air metering system and said fuel metering system are controlled by said controller according to at least one operating parameter of the internal combustion engine which is representative of the content of combustible solid particles in the exhaust gas.

11. Apparatus according to claim 9, in which said electrically powered ignition system includes a timing circuit and is operated during the waiting period of said timing circuit started by an engine starting signal.

12. Apparatus according to claim 10, in which said controller comprises a flame detector and at least one flame-out sensor by whose signal the electrically powered ignition device is controlled.

13. Apparatus according to claim 5, which includes a pressure valve disposed in at least said additional-air line discharging into said combustion chamber.

14. Apparatus according to claim 13, which includes a heat exchanger disposed in said outlet.

15. Apparatus according to claim 1, in which the additional fuel is mixed with a catalytically active fuel additive.

16. Apparatus according to claim 4, in which the additional fuel is mixed with a catalytically active fuel additive.

* * * * *